US006699324B1

(12) United States Patent
Berdin et al.

(10) Patent No.: US 6,699,324 B1
(45) Date of Patent: Mar. 2, 2004

(54) METHOD FOR COATING THE INSIDE OF PIPES AND COATING SYSTEM

(76) Inventors: Klaus Berdin, Droste-Hulshoff-Strasse 1, Legden D-78739 (DE); Eckehard Deggerich, Estern 44, Stadtlohn D-48703 (DE); Klaus Mathmann, Osterwicher Strasse, Legden D-48739 (DE)

( * ) Notice: Subject to any disclaimer, the term of this patent is extended or adjusted under 35 U.S.C. 154(b) by 0 days.

(21) Appl. No.: 09/889,929

(22) PCT Filed: Jan. 26, 2000

(86) PCT No.: PCT/DE00/00208

§ 371 (c)(1),
(2), (4) Date: Nov. 19, 2001

(87) PCT Pub. No.: WO00/44506

PCT Pub. Date: Aug. 3, 2000

(30) Foreign Application Priority Data

| | | |
|---|---|---|
| Jan. 26, 1999 | (DE) | 199 02 977 |
| Mar. 9, 1999 | (DE) | 199 10 293 |
| Jul. 14, 1999 | (DE) | 199 32 783 |
| Oct. 16, 1999 | (DE) | 199 49 947 |

(51) Int. Cl.[7] ..... B05B 13/06

(52) U.S. Cl. ..... 118/306; 118/317; 118/323; 427/421; 427/236

(58) Field of Search ..... 137/355.12; 118/317, 118/306, 323; 427/140, 236

(56) References Cited

U.S. PATENT DOCUMENTS

| | | | | |
|---|---|---|---|---|
| 3,159,895 A | * | 12/1964 | Perovich | 425/317 |
| 3,797,745 A | * | 3/1974 | Haus | 239/227 |
| 4,170,192 A | * | 10/1979 | Maddock | 118/306 |
| 4,204,641 A | * | 5/1980 | Rouse et al. | 239/121 |
| 4,204,645 A | * | 5/1980 | Hopp | 239/341 |
| 4,414,918 A | * | 11/1983 | Nelson Holland et al. | 118/306 |
| 4,582,551 A | * | 4/1986 | Parkes et al. | 156/94 |
| 5,139,751 A | * | 8/1992 | Mansfield et al. | 422/292 |
| 5,309,947 A | * | 5/1994 | Hinger | 138/98 |
| 5,681,131 A | * | 10/1997 | Goldenberg et al. | 405/183.5 |
| 5,813,608 A | | 9/1998 | Yoshioka et al. | |
| 5,913,977 A | * | 6/1999 | Nichols | 118/712 |

FOREIGN PATENT DOCUMENTS

| | | |
|---|---|---|
| EP | 0145266 | 6/1985 |
| EP | 0328802 | 8/1989 |
| EP | 0667188 | 8/1995 |
| EP | 0754902 | 1/1997 |
| FR | 2371242 | 6/1978 |
| FR | 2371627 | 6/1978 |

* cited by examiner

*Primary Examiner*—Richard Crispino
*Assistant Examiner*—Michelle Aewedo Lazor
(74) *Attorney, Agent, or Firm*—James Creighton Wray; Meera P. Narasimhan

(57) ABSTRACT

The invention relates to a coating system in the form of a vehicle (3), which can travel in a pipe (1) or a duct. The coating system is pulled over an appropriately stabilised section of piping (4) in such a way that the inner wall (58) can be evenly coated by a rotating distributor (18) with an outlet opening (29). The various product and supply lines (20, 21, 22, 136) are securely accommodated inside the section of piping (4) by means of a highly resistant flexible tube (138) into which they are drawn. Said flexible tube is air-tightly sealed by covers (148, 149) or a terminal block (150) at the ends and is also configured to absorb tensile forces. The individual supply and product lines (20, 21, 22, 136) are thereby protected in the section of piping (4) without being subjected to excessive pulling or other forces. They are also prevented from interfering with each other. The advantageous, simple, lightweight configuration of the section of piping (4) can therefore be used to continuously clean sections of pipes (1) and ducts of 150 m and more.

14 Claims, 9 Drawing Sheets

118
120
122
125
124
112,123
128
111
133
30
58
119
132
125'
126
127
129
130
110
29
1
23
18
117
116
113
115
60
114
62

METHOD FOR COATING THE INSIDE OF PIPES AND COATING SYSTEM

BACKGROUND OF THE INVENTION

The invention concerns a method for coating the inside of pipes and similar longitudinally stretched hollow objects according to the generic terms of claim 1. The invention also concerns a coating system for the coating of the inside of pipes and similar longitudinally stretched hollow objects according to the generic terms of claim 2.

The pipe line network for the gas supply as well as water and sewer lines of towns and municipalities usually consist of steel pipes that are welded together. While pipes in newer pipe networks have been given an interior coating of e.g. Polyurethane by the manufacturer to protect against corrosion, older pipes do not feature such an interior protective coating and are therefore subject to corrosion which in the course of their operation can lead to leaks. Often, such pipelines are being replaced by a new pipeline after a long operation period. To lay new pipes however is time consuming and expensive, especially when it requires work in the ground or on streets. For this reason, it is aspired that pipes and similar longitudinally stretched hollow objects can be restored from within by giving the inner surface a suitable coating. If the pipes are sufficiently large enough in diameter, suitable machines with spray devices can be inserted and with their help the inner wall can be coated with the necessary Polyurethane or with another coating.

It is also known too first of all test underground pipe lines for eventual damage with a device that rests on the pipe walls. With a post-ceding device the damaged areas are re-coated and repaired. Such a device is known from the U.S. Pat. No. 4,691,728. Similar procedures are known from the PCT WO 96/06298 and PCT WO 96/06299. A process that works on concrete is subject of the DE-OS 14 50 384. In addition, from the DE 196 41 887 A1 a device is known for the thermal coating of the interior of positioned pipes. A motor driven pipe vehicle features a flexible work head at its end which holds a sand blaster jet or a welding torch. The vehicle is driven into the interior of the pipe which first of all will be blasted with the help of the sand blaster jet and then coated with a metal by the means of the welding torch whereas welding material and other coating substances will be added. A coating system that can be driven inside the pipe is described in the DE 198 41 891 A1, where the vehicle features a distributor, which more or less exactly applies the coating to the inner wall. A defined coating of the pipe is therefore not mentioned especially since the vehicle can only be moved towards one direction via a rope. A vehicle pulled by a section of piping is known from the EP-A-O 145 266. The vehicle consists of two parts and runs on fixed, non-adjustable skids, features a camera that precedes the vehicle in the main travel direction and which can only extend the rotor sprayer by a minimal degree against the travel direction to correct eventual mistakes immediately. The section of piping is being rolled onto or off a power driven spool without guidance.

SUMMARY OF THE INVENTION

The invention has the task to create a method and a coating device with which an interior coating of pipes and similar longitudinally stretched hollow objects can be achieved that can be defined and adapted to the individual conditions of the interior wall of the pipe.

The task is solved according to the invention by the characteristics of the typifying parts of claim 1.

With such a method, it is first of all possible that a defined inner coating can be applied because the process can continuously be monitored and corrected. The fact that the vehicle is moved through the pipe via the section of piping and exclusively via the section of piping, it is ensure that the section of piping into which the various components are pumped from the storage containers to the deployment location is always tight so that operational disruption through a bend or similar circumstances cannot take place. The vehicle and therefore also the distributor are always positioned in the middle of the pipe or the duct so that it is guaranteed that the mixed components from the distributor or the corresponding material always travel the same distance and settle evenly on the inner wall. The vehicle is being pulled forward via the section of piping, however, with a suitable device it can also be pulled in opposite direction so that flaws detected through monitoring can be corrected immediately, meaning without traveling long distances. Thus, a continuously even coating or securing of the inner wall of the pipe is guaranteed. The section of piping is safe from any bends or other disruptions and can foremost ensure a smooth movement of the vehicle which is additionally supported by the tensile design. The section of piping which carries the different components as well as compressed air and electricity remains undisturbed during the rolling on and off process because the section of piping in the tensile design also has an appropriate stability. Moreover it is intended in addition that the section of piping that moves the vehicle is guided onto and off the spool which also serves as a drive and thus it always remains connected with the coating agent storage containers. This special method ensures that even with a short noticed stop of the distributor or standstill of the vehicle the coating process can immediately continue after the vehicle continues to move. The necessary coating material but of course also the additional components are always readily available.

To complete the procedure, a coating system to coat the inside of pipes and similar longitudinally stretched hollow objects is intended which is equipped with a vehicle that is guided along the inner wall of the pipe by a drive and which features a distributor for the coating agent. The vehicle is connected with at least one coating agent storage container via a flexible section of piping whereas the section of piping is connected with a spool positioned outside the pipe whereas according to the invention the spool which serves as a tensile drive via the section of piping and which features a drive and a central, pipe-shaped spool axis whose at least one free end is equipped with a sealed pivotal connector at whose solid part at least one feed line from a coating agent storage container comes in and whose part that is connected with the pivotal part of the spool is connected to one of the product lines in the section of piping which in turn forms the tensile section of piping together with if necessary additional for the operation of the vehicle required supply lines. The section of piping can be rolled off the spool. The vehicle then also features a camera car and a rope on the side where the rotating distributor is located. Thus a coating system has been created which first of all can be pulled in one direction through the pipe or the underground duct evenly and without disruptions via the spool featuring the drive and the section of piping. Since the spool is positioned on the ground, special safety measures which otherwise would have to be considered do not have to be followed. Therefore the drive can be very simple in its design. A direct and constant connection of the vehicle and the distributor with the coating agent storage container is possible via the pivotal connector. The same is true of course with multiple storage containers.

The section of piping itself is tensile so that there are no relaxed portions within the piping and thus no irregular operation of the vehicle. On one side the vehicle is connected with the section of piping and on the opposite side with a rope where also a camera cart can be attached which can monitor the coating process continuously and can ensure that when mistakes occur, for example irregular coating or missing sections of coating, the vehicle can immediately be stopped and pulled in the opposite direction in order to correct the mistake immediately while the process is being monitored.

In order to ensure an even rolling up and rolling off of the section of piping onto the spool over extended time and with multiple rolling up processes, the invention intends that the drive of the spool and the drive of a pair of preceding pressure rollers feature an electronic control which match the even pulling force one the one hand and the speed to roll up the section of piping on the other hand. Thus, over extended time, the powered spool can be used as the exclusive drive for the vehicle that is to be moved in the duct or in the pipe whereas the preceding pair of pressure rollers ensure the even rolling on and rolling off process as well as the even supply of section of piping.

According to further development it is intended that two pairs of pressure rollers are intended which are positioned one after the other towards the pulling motion and of which each features one pressure roller that is powered whereas the other pressure roller follows due the frictional pressure of the coating surface of the section of piping while the drive of the spool is built so that it follows the drive of the pairs of pressure rollers and at least one pair of pressure rollers can be extended parallel to the spool axis preferably on a carriage. Thus the section of piping can be evenly rolled on and off while it is ensured that the section of piping is also evenly moved between the spool and the pairs of pressure rollers while at the same time the rolling up process is facilitated because the pairs of pressure rollers move back and forth in front of the actual spool in such a way that the section of piping can always be rolled on tightly together onto the spool or rolled off the spool.

The even distance of the vehicle to the inner wall is ensured by the fact that the vehicle features a casing with six or more in radial direction extended gliding skids whose contact surface can be set towards the longitudinal middle axis of the vehicle. Thus the necessary adaptation to the changing diameter of the pipe can take place while it is thinkable that the gliding skids feature corresponding rollers or other glide media if this is deemed necessary and useful.

An even coating of the inner wall of the pipe or duct cannot be ensured by a simple spraying on of the coating material because the rotating distributor can also easily apply coating material onto already applied coats. In order to ensure most optimal coating it is intended that the rotating distributor is designed as a rotation symmetrical pot with outlet openings and that it features a pipe which leads into the inside of the pot and is fixated opposite to the casing of the vehicle and features a beveled open end piece whereas as the slanted opening points outwards to the closest area of the inside wall of the pot. Due to the outlet openings which are differentiated in at least two groups, it is possible to achieve a sufficient thickness of the coating as well on critical parts of the inside of the pipe such as at steps, ledges or inward pointed elevations. In relation to this effect it is especially advantageous when the outlet openings of the first group are tilted forward in relation to the longitudinal axis of the vehicle or the pipe and the outlet openings of the second group are tilted backward in relation to the longitudinal axis of the vehicle or the pipe. In this case, for example with inwards pointed elevations on the inside wall of the pipe the corners of such ledges which are pointed backwards in relation to the direction of the vehicle will be reached by the forwards pointed coating material jet while on the other hand the corners that point forwards in relation to the direction of the vehicle are reach by the coating material jets that face backwards so that overall, even at such critical points, a sufficient coating can be achieved. The outlet openings are preferably mostly cylindrically shaped drillings in the material of the distributor. The drillings allow a coating jet to be exactly defined in terms of its exit angle. The rotation symmetrical pot of the distributor prevents an uncontrolled release of coating material because the diameter of the inner wall at the open end of the pot is less than at the axial portion of the inner wall from where the distribution outlets start. Due to the exact placement of the pipe end inside the pot it is ensured that the transportation of the coating material happens on the shortest distance into all areas in the pot that feature outlet openings. Also, it is prevented that the coating material gets into areas where it could be distributed in an uncontrolled fashion for example at the open rim of the pot.

Another useful design intends that the rotating distributor is designed to function as a spray-gun with a radial positioned outlet opening and integrated mixer and that the shaft of the pivotal drive which turns the spray gun features a media through put or is a media through put. Thus is it possible for the first time, specifically, and in terms of the surrounding quasi continuously, to apply the coating agent without running the danger that an application of a coating agent is too thick or that a double application through the jets would cause the coating material to drip or to run. Instead, an exact, predetermined amount of coating material or two component mixture is applied onto the inner wall of the pipe by the spray gun which proceeds with the coating process in a spiral-like motion because the vehicle is moved evenly along the inside of the pipe. Due to the special design it is possible to select the thickness of the coating in such a way that when the connecting point is reached after one full turn of the spray gun the two component mixture is hardened enough that dripping or running is no longer possible. It is especially advantageous, however, that with a spray gun according to the invention the coating process can be disrupted at any time because the mixing of the two components happens inside the spray gun, and to be exact, in the spray head, so that after the appropriate off-time usually the coating (process) can be continued without any problems. This can be achieved for example by the fact that the compressed air that is already transported any way is used to clean the gun so that the completely clean spray gun is ready to continue the coating process. Thus, it is possible for example to plan the coating in sections and thus only in the areas that have damages in order to then move the entire vehicle to the next location and to continue the spraying again. For the first time it is therefore possible without driving back and forth for several meters or to spray more then 100 meters in sections because liners or other similar objects do not have to be used.

According to another useful design of the invention it is intended that the media through put is designed as a cylinder casing with a component connector for the two components and the compressed air connector and that the cylinder casing houses the shaft which is connected with the compressed air powered pivotal drive and that the shaft features outer ring channels and axial sack drillings that correspond with the connectors. The two components as well as the compressed air are inserted into the rotating spray gun via the media through put without causing a strain on the section of piping. The two components and the compressed air are transferred gently from the distribution station above ground to the job site inside the pipe to the be induced through the media through put into the spray gun to be mixed there and sprayed on. As it is seen in the characteristics in the claims section, the components can really be transported separately until close to the mixing location upon which they are being transported all the way to the handle of the spray gun. It is an advantage that the compressed air, which is also needed for other purposes that will be explained later, is used to turn the shaft and thus the spray gun. Via the compressed air the rotation speed can be set so intricately that the previously described even application effect can always safely be achieved.

The vehicle is moved in the pipe line or the duct via the section of piping which can be rolled up. On the one hand to enable an exact positioning of the vehicle in the pipe and also to take care of corrections, the invention intends that on the free end of the spray gun a flexible rope attachment piece for a rope is positioned that can be pulled in opposite direction. The rope that pulls in the opposite direction gives way enough that the vehicle can be moved in its intended direction but can also be activated in such a way that the vehicle moves backwards in its intended space or in other words is pulled backwards. A strain on the rope is being avoided because a pivotal head is intended between the turning spray gun and the rope pulling in the opposite direction so that the spray gun turns without transferring this motion onto the rope.

The portrayed section of piping can serve in a double function due to the fact that it consists of the two separate product lines which can be heated and two partial shells and a middle piece which features channels or partial channels for the product lines and additional support lines. Thus, a sufficiently stable enough layer can be placed around the product lines and the supply lines which for once takes care of the fact that the necessary pulling forces are transferred but that at the same time an isolation of the inner lines takes place which ensures a flawless operation of the coating system. Only when both products are transferred to the job site at the right temperature, a correspondingly fast and safe hardening at the inner wall of the pipe or the duct wall is required and accordingly possible. Accordingly, there are channels for the products lines intended in the lower half shell. The other supply lines are either arranged around the product lines or mostly in the upper half shell so that after integrating the appropriate lines the two partial shells and the middle piece can be inserted into each other and fixated in such a way that an even operation of the entire coating system is guaranteed. To connect the two partial shells that can be integrated and that enclose the middle piece, it is intended that the two partial shells are connected via a groove-spring connection, the middle piece and the product and supply lines fixated and connected with each other. The groove-spring connection can easily be complemented for which usually glue or other similar materials are inserted into the groove, so that the insertion of the spring enables a simple and safe connection. It is also thinkable that groove and spring are designed to correspond with each other so that by putting (them) together a first fixation is achieved.

An additional design of the invention intends that the rotating distributor features a radial positioned and executing outlet opening which corresponds with an atomizer air spray jet which is fitted with an airflow change nut that influences the spray angle of the media output. Via such a designed rotating distributor it is possible due to the corresponding air spray jet to wrap a layer of air around the individual coating jet which therefore guides the two component mixture exactly onto the inner wall of the pipe that is to be restored. Due to the air layer the over-spray of the two component mixture is also made more difficult. Depending on the shape of the air ring channel around the coating jet it can be worked exactly so that the air channel is widened just prior to the jet hitting the wall so that material over-sprays can be prevented. It is advantageous that via the air jet change nut the spray angle can always be changed and thus to accommodate the given situation. If for example the distance between the outlet opening and the pipe wall is small it usually is advantageous when a large spray angle is used while with larger distances the spray angle gets smaller or is small in order to guide the media jet exactly onto the inner wall of the pipe. Thus, it is thinkable that the air pressure change nut is either remotely set or set prior to putting the system underground in order to select a most exact definition of the media jet in connection with the air distribution jet.

Additionally it is intended that the rotating distributor consists of a supporting pipe with interior mixer which is connected with the spray head of the spray gun, an angled pipe with the outlet opening and the air pressure regulating nut whereas in the end piece of the angled pipe which points towards the inner wall there is an additional mixer reaching all the way into the outlet opening and whereas the atomizer air jet is detachably connected with the angled pipe and consists of two jet parts which are connected via a thread and of which the jet part that is positioned at the free end is designed as the air regulating nut. The design is therefore appropriately simple and thus can be manufactured cost effectively enough that it can be exchanged if necessary. According another useful design which is detailed in a later part of this documentation it is possible to blow out the distributor in order to, even with slightly longer breaks, prevent the caking of the two component mixture inside the distributor or inside the supporting pipe and the air jet. The previously described simple design of the rotating distributor still facilitates a long mixing process for the two components so that with exiting the outlet opening the necessary requirements for a fast adhesion and setting of the two component mixture are in any case fulfilled. After the re-routing of the previously mixed or pre-mixed two component mixture the material is then pushed through the second mixer and is handled intensively enough that the previously described optimized amalgamation is given when exiting out of the exit jet. An exchange of the air jet at the end of the supporting pipe and the angled pipe is possible because the air jet is detachably connected with the angled pipe and consists of two jet parts which are connected via a thread of which the jet part which is positioned at the free end is designed as the air regulating nut. With that the regulation of the coating jet is easily possible because only the air pressure regulating nut, thus the jet part which is positioned at the free end, has to be turned on the thread in order to regulate the angle of the jet to correspond with the situation.

The compressed air that is necessary to form the air in layer is added in the shortest possible way and that is because that the jet part that is connected with the angled pipe features an air connector and an air distribution chamber which is connected via axial air channels with a second air distribution chamber in the air pressure regulating nut, whereas a connector for compressed air is intended in the area of the spray head which via a pivotal connector ensures a continuous supply of air and which can be connected between the supporting pipe or the mixer and the medium valves. Due to the positioning of the air chambers it is ensured that with exiting from the exit ring channel an even air layer is being formed so that outbursts of the two component mixture can be prevented. For that, the second air chamber in the air pressure regulating nut is especially important, whereas it is shaped like a half dome and in such a way that the lowest point points toward the exit ring channel so that compressed air is being released in this area and thus exits appropriately. Thus, the compressed air can specifically enter in this area and can exit appropriately. An especially specified and even air layer is put around the coating jet. Thus, it is also thinkable to change the thickness of the wall of the exit ring channel, however, for this the air pressure regulating bolt would have to be equipped with a special feature. Usually, it is sufficient if the once set or pre-determined exit ring channel ensures that a sufficiently thick air coat is created whereas of course the exit speed of the compressed air from the exit ring channel has also to be taken into consideration. The rotating distributor is blown out at or shortly prior to standstill in order to use it again without any problems. Through the rotating connector it is ensured that the compressed air flows continuously and not only when the rotating drive has come to a standstill. This has the advantage—as further explained later in the text—that the connector for the compressed air can also simultaneously be used for the supply of the air jet.

The section of piping can advantageously be used for the supply and for the drive of the vehicle by integrating product lines and electrical supply lines in a highly resistant flexible tube thus building the section of piping. At the end facing the vehicle the section of piping is air tightly sealed by a cover or facing the tube spool side it is air-tightly sealed by a cover featuring a terminal block and at the same time it is configured to absorb tensile forces. The product lines which transport the two components of the coating material point towards each other in the outlet opening preceding the mixer which also features a compressed air supply line with an air jet that connects in a right angle to it. Such a designed section of piping makes it possible to pull the required product lines, supply lines and other cable or other similar items into the highly resistant flexible tube and to store them therein. In the event that the 150 m long or longer section of piping shall be used to pull the vehicle through the duct or the pipe, the section of piping or better the highly resistant flexible tube is filled with compressed air and inflated to the extend that the highly resistant wall effectively protects the product lines and supply lines within and also ensures the necessary isolation. Through the air that is built up in the highly resistant tube the product lines are kept at temperature as much as necessary because the air can act as an isolator and thus be supported by the wall of the tube. In addition, tensile forces can be applied without running the danger that the product lines or supply lines can be overly strained and effected by the tensile forces in any way. It is also advantageous that weight can be reduced by omitting a section of piping that fully consists of material. It is especially advantageous that the manufacturing of such a protective coating for the product lines, electrical supply lines and other lines is expressively simple because only a highly resistant tube is necessary which doesn't require any preparation procedures. It is only fixated through covers at the ends and/or terminal blocks and equipped in such a way that it can on the one hand be connected with the vehicle and on the other hand connected with the roll up device. The coating material is being pumped through the product lines to the vehicle and is mixed here in such a way that the two components are applied at the same time to the inner wall of the pipe or duct. It is followed by a pressure mix with injector effect because the compressed air which is induced at the same time, therefore the mixed or pre-mixed coating material is pressed and pushed into the outlet opening and thus into the jet so that the coating material is thrown onto or sprayed onto the inner wall as a complete mixture. It has been found that with the described design the mixing of both components can happen on short distances and fast so that correspondingly smaller built devices can be used. The individual component material that exits from opposite from each other positioned openings of the product lines is swept away by the air stream and is skillfully mixed and increased in speed so that it can even be applied to pipes featuring larger diameters without bouncing off the inner wall. To fulfill this purpose, the product lines transport the coating material under appropriate pressure. For example, the component material which is required in large quantities is pushed through the section of piping with 100 bar whereas the component material that is required in a lesser quantity is transfer with 50 bar to be joint at the mixer. By changing the pressure the quantity can thus be changed and adapted to meet the individual requirements whereas depending on the applicable situation and the coating material that is to be used the quantity of the component is predetermined and thus also the pressure conditions relating to the two product lines.

Previously in the text it has been indicated that the highly resistant flexible tube is sealed by covers at the ends and that it is also configured to absorb tensile forces. At the same time the necessary also tensile connection between this part and the highly resistant tube is ensured by the fact that the cover or the terminal block is connected with a tube spout which is positioned far into the tube and held by an outer teethed link and which is equipped with corresponding ring grooves to hold an O-ring. The tube spouts with their outer teethed links are inserted into the tube prior to it being pressurized. Thus, a positioning is possible, whereas it is practically impossible to pull out the tube spout due to the outer teethed link and this effect can be increased if necessary by tube clamps. With the appropriate fixation of the tube spouts in the highly resistant tube, the opportunity is created to tightly attach those tube spouts at the cover or the terminal block especially to screw them in. The necessary sealing effect in the area of the cover and the terminal block is created by the O-rings. Thus the area between cover and tube spout is effectively sealed so that the compressed air cannot unintentionally escape. Moreover, the compressed tube or better the tube that is filled with compressed air remains in its secured position so that the other contained supply lines are undisturbed and protected.

The tube which is sealed on both ends by the covers or the terminal block is to be inflated when in operation in order to ensure the appropriate safety of the product lines, compressed air line and supply lines and to perfectly absorb the tensile forces. For this the invention intends additionally that the cover on the side of the tube spool features a connector drilling for a low pressure line to add compressed air, preferably ranging from 2 to 4 bar and that the drilling features a sealing coating that works together with the outer wall of the product lines, compressed air line and supply line. With this low pressure line, compressed air is guided into the inside of the tube so that it can inflate due to the fact that it is closed and sealed on both ends with the covers so that therefore it obtains the necessary stiffness or that its stiffness is ensured. The coating can of course also be assigned to the individual supply lines and other lines, however, it is really only necessary in the area of the insertion in the area of the drilling so that it is more useful to equip the inner wall appropriately. The appropriate coating has the additional advantage that an even insertion or pulling through motion of the supply and other lines is facilitated.

The section of piping that is being used or the appropriate tube has a total length of 150 meters or more, and it is rolled up on an appropriate tube spool or is rolled off of it depending on which the direction the vehicle moves towards. On the one hand to absorb tensile forces that develop and on the other hand to optimize the flexibility of the tube in the best way it is intended that the wall or the highly resistant tube features a reinforcement whereas this reinforcement does not necessarily have to be designed in a spiral shape but can also consist of rings that are either set on the outside of the tube or are integrated in the tube or are positioned on the inside in order to ensure the appropriate stability. The spiral shaped design as well as the ring shaped design ensures that the tube can be rolled up in any case.

The invention distinguishes itself especially by the fact that a method for the interior coating of pipes and similar longitudinally stretched hollow objects has been designed and that in addition a coating system with which the application of the coating material is enabled continuously and in such a fashion that the coating procedures in sections of 150 metes or more have an even and flawless result. The vehicle is pulled evenly through the pipe or duct that is to be coated by the powered section of piping which can absorb the tensile forces and which is to be pulled evenly through the duct or the pipe by the especially designed spool. Loops or entanglements are not possible so that an even supply of the vehicle and the distributor is ensured. The section of piping is simple in design and can be inflated so that the interior product lines and supply lines are very safe and that at the same time it is possible to keep the temperature (warm) so that the coating components can be transferred safely to the distributor even over great distances. The vehicle is always guided in the center of the pipe, can be moved in both directions and allows an immediate supervision of the coating effort so that mistakes can be corrected very quickly and on the shortest distance possible.

Additional details and advantages of the invented object can be found in the following description of the corresponding drawings where a preferred design example is depicted with the necessary details and individual parts. It is shown in:

DETAILED DESCRIPTION OF THE PREFERRED EMBIDIMENT

Figure 1:
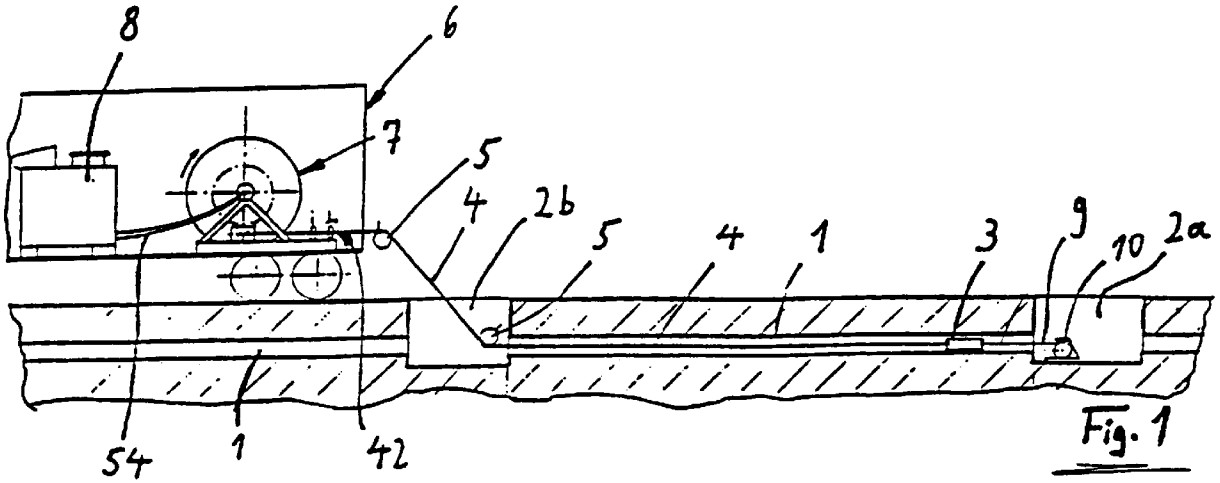
FIG. 1 a coating system to coat the inside of pipes in an extremely simplified drawing, FIG. 2 a vehicle that can be moved inside a pipe, FIG. 3 a distributor in a sectional diagram, FIG. 4 an interior view of the distributor, FIG. 5 a front view onto the vehicle, FIG. 6 a sectional diagram through a section of piping, FIG. 7 a side view of the spool onto which the section of piping is rolled onto, FIG. 8 a view onto the spool from above, FIG. 9 a back view onto the spool, FIG. 10 a side view of the vehicle, partially in a section FIG. 11 a sectional diagram through the section of piping, FIG. 12 an explosion drawing according to FIG. 11

The essential elements of the coating system are explained at first with the overview diagram of FIG. 1. A to be restored pipe 1 is located in the ground and for the restoration process it is divided into individual pipe sections. The pipe sections are separated from each other by pits 2. Therefore the to be restored pipe section is located between two consecutive pits 2.

The restoration of the pipe takes place by coating its interior lining. For this, a vehicle 3 is moved through the pipe 1 by pulling it through the individual pipe section by a section of piping 4 that withstands tensile forces and is wear and tear resistant and equipped with supply lines for the vehicle 3. Thus the vehicle 3 travels from pit 2*a* to pit 2*b* where the vehicle exits from the pipe 1. Guiding rollers 5 are used to gently guide the section of piping 4 which is finally rolled onto a spool 7 that is mounted on a service vehicle 6.

The service vehicle 6, e.g. a truck, holds in addition to the spool 7 various supply containers, e.g. two coating agent storage containers of which only one container is depicted on FIG. 1 in order to simplify the overview. The coating agent storage containers contain products that are transported to the vehicle 3 via the section of piping 4 that also serves as a flexible pull element so that they can process the inner coating of the pipe 1 at its location.

In order to pull the section of piping 4 to the end of the pipe 1 at the pit 2*a* prior to the coating procedure, the section of piping 4 can temporarily be linked with a rope 9 which is connected with a motorized winch on its other end. By operating the winch 10, the section of piping 4 with its containing supply lines can be pulled by the rope 9 to the individual end of the pipe. Then the rope 9 will be detached for which corresponding coupling elements 43 on the section of piping 4 and on the rope 9 are intended. Then the vehicle 3 will be connected with the section of piping 4 upon which the coating process can be initiated by pulling the section of piping 4 in an exactly controlled manner.

Instead of a direct connection between the section of piping 4 and the rope 9 via the coupling elements on both sides it is also possible to pull the vehicle 3 with the rope in to pipe 1 almost all the way to the pit 2*a* while it is already connected with the section of piping 4. This case is depicted in FIG. 1.

Figure 2:
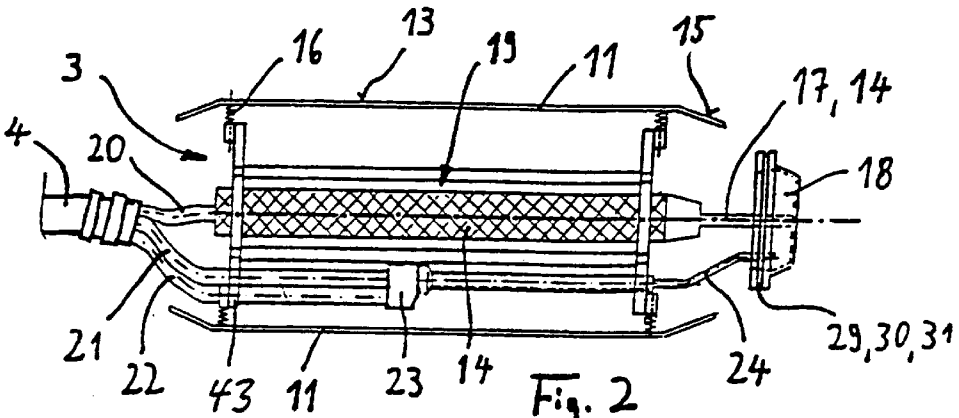
Figure 5:
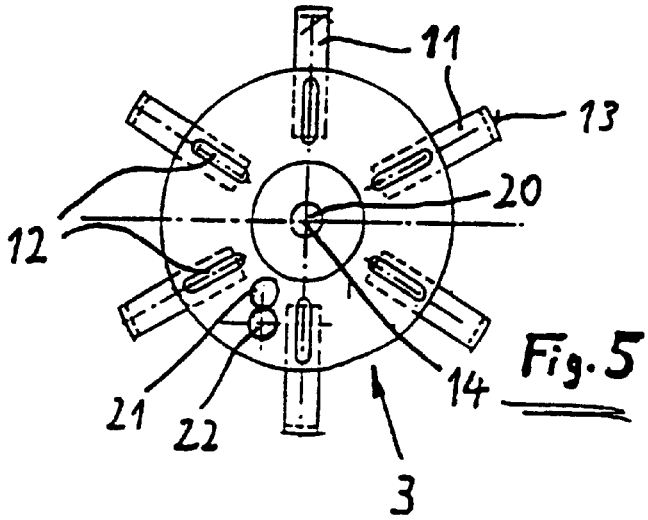

With FIG. 2, the following details of the vehicle 3 are explained while it is pulled along the inner wall of the pipe. It consists of a casing with six or more skids 11 that extend in radial direction The skids are positioned in equal angles to each other. Via elongated holes 12 and corresponding screws the skids can be move in a radial direction so that the radial distance of the surface 13 of the skids 11 to the longitudinal axis 14 of the vehicle 3 can be set. This can be seen especially well on FIG. 5. Thus, the effective diameter of the vehicle 3 can be adjusted to fit the individual interior diameter of the pipe. In addition, the skids can be exchanged so that skids with larger radial extensions can be used for larger pipe diameters. The skids feature bevels 15 at both of their ends so that it is ensure that they can glide along the interior wall of the pipe without a problem. Each skid 1 is mounted on springs 16 to allow a certain compensation towards irregularities of the inner wall of the pipe. The length of the skids 1 is at least two thirds longer than the diameter of the pipe 1. For example, if the pipe measures 300 mm in diameter, the length of the skid is at least 500 mm.

An important element of the vehicle 3 is the distributor 18 which is located at one end of the vehicle on centrally positioned drive shaft 17 in the shape of a pot that opens towards the vehicle. The drive shaft 17 is centrally positioned, therefore matching the longitudinal axis 14 of the vehicle 3 and is powered by an air compressor 19 with at least 15,000 to 17,000 revs per minute and up to 30,000 revs per minute. The air supply of the air compressor 19 takes place via the compressed air line 20 which is part of the section of piping 4.

In addition to the compressed air line there are another two product lines 21, 22 that lead into the vehicle 3. The product lines 21, 22 are also part of the flexible section of piping 4. The product lines 21, 22 lead to the preferably heated mixer 23 inside the vehicle casing. Here, the two products are mixed to become the desired coating agent. This (mixture) reaches the inside of the pot-shaped distributor 18 via a rigid pipe 24.

Figure 3:
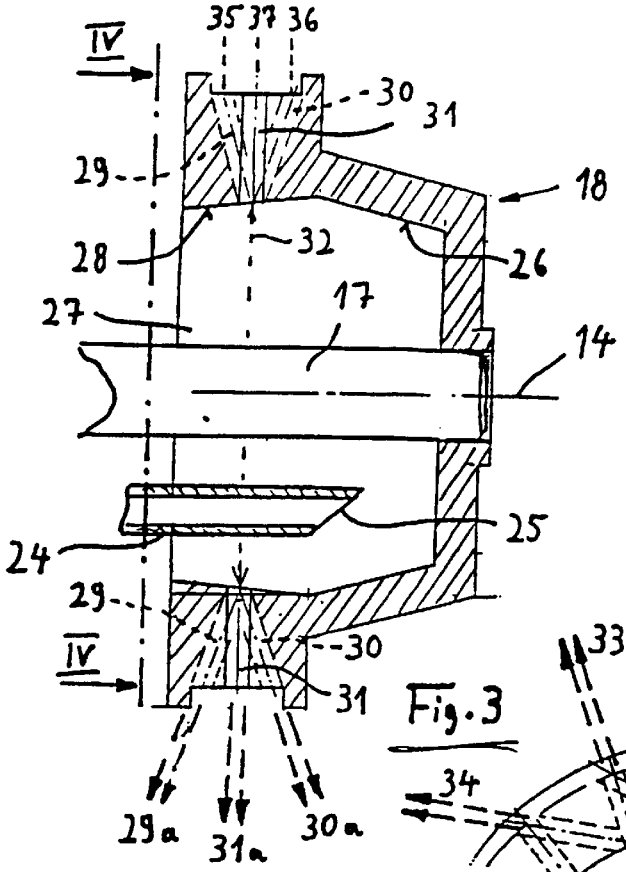

As it is visible in FIG. 3, the pipe 24 is located in an offset position to the central drive shaft 17 and features a beveled opening on its free end between 30 and 40 degrees through which the coating material can exit. The beveled edge 25 points outwards to the closest area of the inner wall 26 of the pot as can be seen in FIG. 3.

With the vehicle 3 it is possible to preferably apply a polyurethane coating to the interior wall of the pipe. For this, one product line 21 carries for example Polyol and the other product line carries for example Isozyanat to the heated mixer 23.

Details of the pot-shaped distributor are explained as follows with FIGS. 3 and 4. Besides the drive shaft 17 which is made of steel the entire distributor 18 is made of plastic or aluminum. Due to the shape of the pot it is outwardly closed and features an opening 27 towards the vehicle 3, which, like the entire distributor 18, is rotation symmetrical in relation to the longitudinal axis 14. This prevents imbalances in view of the high number of revolutions.

The inner wall 26 of the pot is conically shaped towards its front wall 28. The inner wall towards the vehicle, on FIG. 3 on the left, is shaped as a cone 28 which however becomes narrower towards the opening 27. The diameter of the inner wall 26 is therefore less at the open end of the pot than at the axial section of the inner wall from where the outlet openings 29, 30, 31 are positioned. The outlet openings 29, 30, 31 extend from a common circle 32 which is defined on the inner wall 26 of the pot. For better display purposes, the circle 32 is sketched with short lines.

The outlet openings 29, 30, 31 are basically cylindrical drillings in the plastic material of the distributor 18. The outlet openings 29, 30, 31 are divided into three groups:

The first group of outlet openings 29 points forward in relation to the longitudinal axis 14 resulting in the coating jet 29*a*. A second group of outlet openings 30 points backwards in relation to the longitudinal axis 14 resulting in a coating jet 30*a*. A third group of outlet openings 31 are set in an exactly radial position to set a coating jet 31*a* in a right angle to the longitudinal axis 14.

Figure 4:
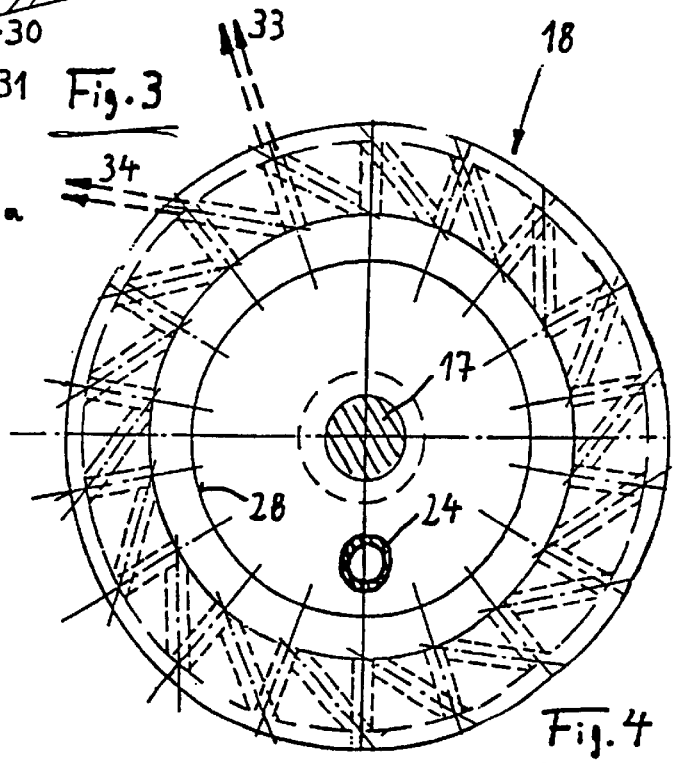

FIG. 4 shows that by looking at a sectional diagram of the pot, the outlet openings 29, 30, 31 can have different exit angles. While one outlet opening extends radial and results in a radial coating jet ee, other outlet openings are tangent so that in each case it results in a tangent coating jet 34.

All outlet openings 29, 30, 31 are evenly distributed over the circumference of the pot whereas the relation between the number of the outlet openings 29, 30, 31 is 1:1:2.

Through the different angles of the three outlet openings 29, 30, 31 three circles are defined that are off-set in axial positions to each other on the outer circumference of the distributor, in FIG. 3 indicated with the corresponding numbers 35, 36 and 37, and which indicate the axial locations of the mouths of the outlet openings 29 or 30 or 31.

While the vehicle is in operation, the coating material comes through the pipe 24 which is fixated in the casing of the vehicle until it reaches the beveled edge 25 and from there hits the inner wall 26 of the pot which rotates at a high revolution. Thus, the material is distributed evenly onto the inner pot circumference and due to the high centrifugal forces exits through the outlet openings 29, 30, 31 so that the coating material is flung onto the inner wall of the surrounding pipe and sticks there.

Figure 6:
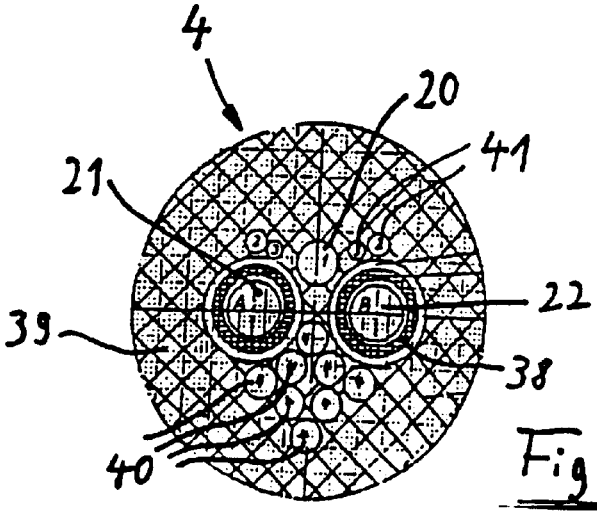

FIG. 6 shows a sectional diagram through the section of piping 4 with the product line 21 for Polyol, the product line for Isozyanat and the compressed air line 20. The two product lines 21, 22 together are the supply line that leads to the mixer 23. Both product lines 21, 22 are equipped individually with their own heating system. This consists of a interior Teflon tube and a metal mesh 38 that surrounds it and which carries electricity and an outer protecting tube that in turn is directly imbedded in a vulcanized rubber coating of the section of piping 4.

The heating of the supply line takes place in sections for which a corresponding number of inlets 40 are imbedded into the rubber coating 39. In addition, sensor lines 41 are imbedded to control an exact, pre-determined temperature of the individual sections.

The rubber coating 39 of the section of piping 4 consist of a relative resistant tensile material so that the tensile forces that are necessary to move the vehicle through the pipe can be applied without causing damage to the individual lines inside the section of piping.

Figure 7:
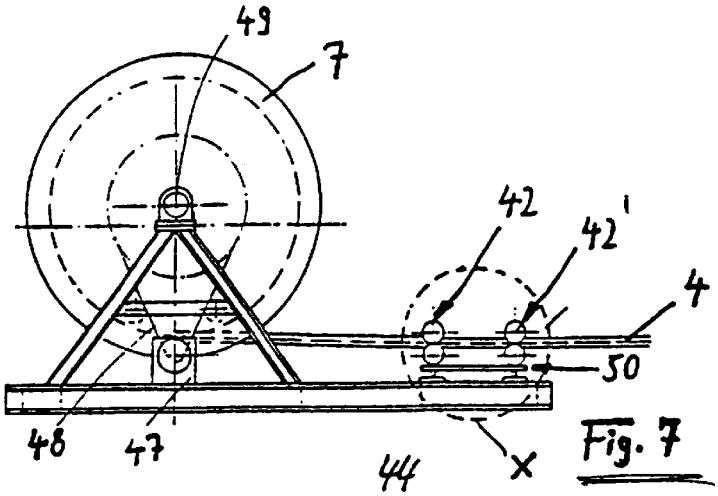

FIGS. 7 through 14 relate to the rolling up of the section of piping 4 onto the previously described spool. The necessary tensile forces for the pulling of the section of piping 4 however are not a result of the drive of the spool 7 but come from a separate drive which consists of pairs of rollers 42. In the overview drawing according to FIG. 1, there is only one pair of rollers 42 depicted whereas in the designs according to FIGS. 7 through 9 there are altogether two pairs of rollers 42 present. Each pair of rollers 42 consist of a powered pressure roller 44 and an additional pressure roller 45 which is operated due to the friction connection with the surface of the section of piping 4. The two pressure rollers 44 can be operated via a common drive 46 via appropriate belts, as can be seen in FIG. 7.

The spool 7 is also equipped with a drive 47, preferably also with a belt 48. An appropriate, electric control ensures that the roll up speed of the drive 47 operates with the same speed than with which the pair of rollers transport the section of piping 4. In order to operate the speed control in very small increments the pulling of the section of piping 4 however takes place exclusively via the pairs of rollers 42 which allow for a very precise speed control with high tensile forces due to their small diameters. The drive 47 of the spool 7 therefore only operates as a lagging drive.

Figure 8:
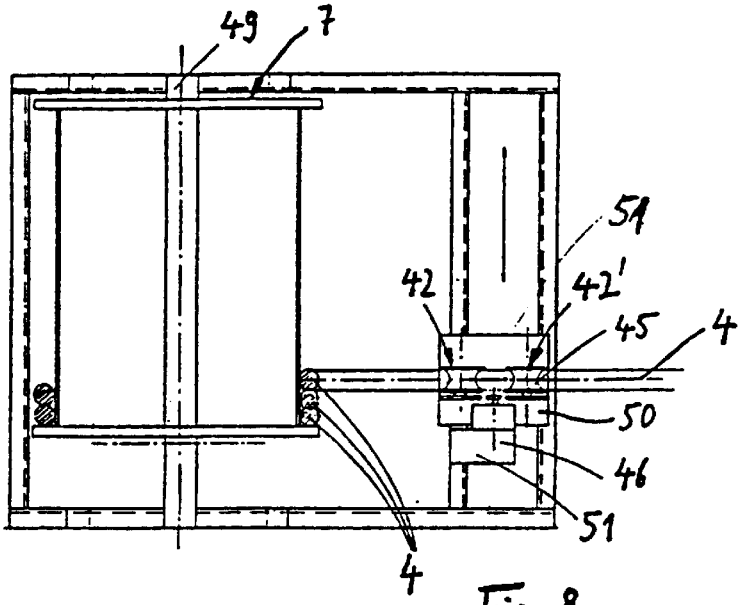

FIG. 8 shows that the individual windings of the section of piping 4 are rolled up so that they are located next to each other on the spool 7. In order to avoid an overlay of the individual windings, the pair of rollers 42 are located on a carriage 50 that can be moved in parallel direction to the axis of the spool 49. The movement of the carriage 50 parallel to the axis of the spool 49 is coordinated with the transport speed of the pressure rollers 44 which means the carriage operates with such a speed that the individual windings of the section of piping 4 come to rest exactly next to each other on the circumference of the spool 7. For this, the drive of the carriage 50 is coupled with the drive of the pressure rollers 44 via a gear system 51.

The powered pressure rollers 44 as well as the non-powered pressure rollers 45 can be equipped with a runner coating to increase the friction so that a higher friction and thus higher tensile forces can be applied onto the section of piping 4.

Figure 9:
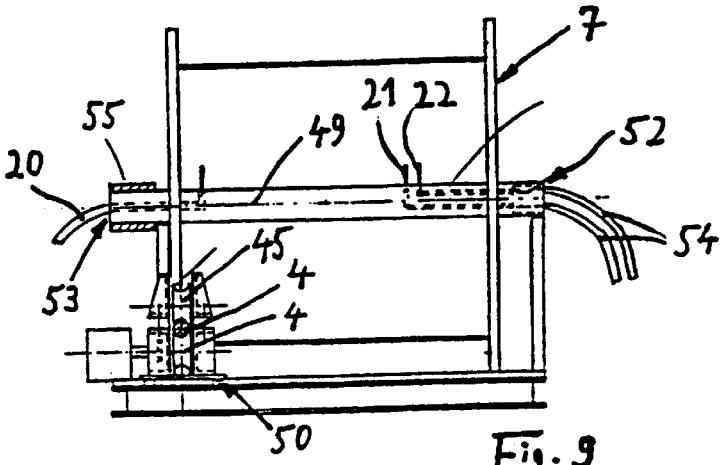

Because the section of piping 4 and the lines and supply lines within end inevitably at the spool 7, pivotal inserts are required at this point. FIG. 9 shows that the spool axis 49 is equipped on both ends with sealed pivotal connections 52, 53 which extend from the spool axis. At the fixated part of the pivotal connections there are connectors attached whereas the connectors 54 lead to the coating material supply containers 8. A double line is connected with the pivotal part of the pivotal connector 52 which first leads along the spool axis 49 and then extends into the product line 21 or the other product line 22 of the section of piping 4.

The addition of compressed air for the air compressor takes place via a corresponding pivotal connector 53. Finally, pivotal contacts 55 are intended via which electricity runs to the heated sections as well as with which the electric sensor lines are checked.

Figure 10:
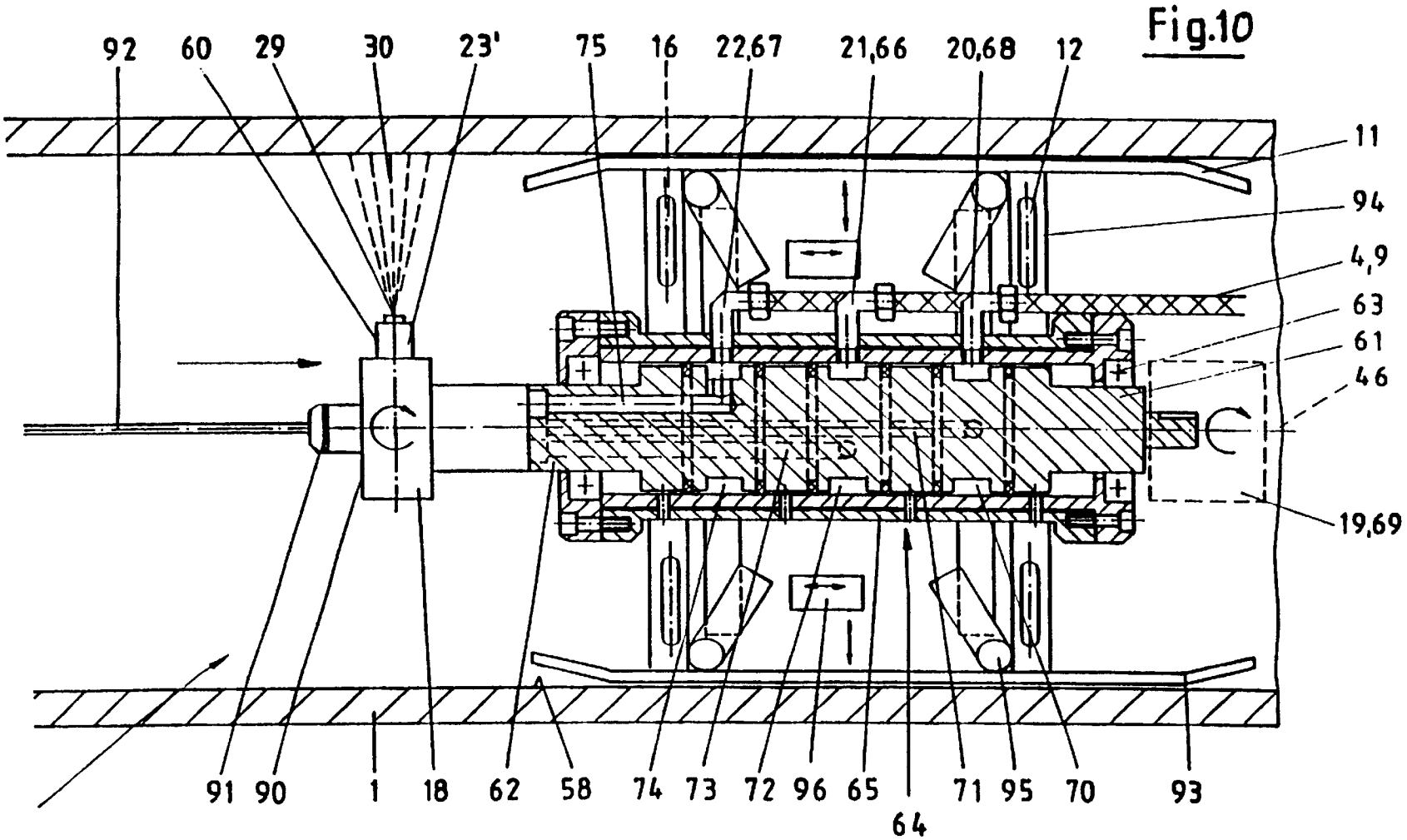

FIG. 10 shows a pipe 1 in a cross section in which a vehicle 3 can be moved evenly. For this, only the indicated section of piping 4 is used which also serves to bring the required media or components. Not shown is a roller that changes the direction which leads through the pipe 1 to a vertical channel in order to be rerouted above ground or to the area of the street where a service vehicle is located which is also not depicted and on whose spool the section of piping 4 is rolled onto.

The vehicle features a number of gliders 11, 93 preferably six of such gliders which are pushed onto the interior wall via telescope fixtures 94 that hold the gliders. The telescope fixtures 94 that hold the gliders which feature springs that are not depicted, is positioned via pressure rollers 95 which can be moved via pneumatic cylinders in such a way that they push the gliders 11, 93 either against the inner wall 58 or that they enable a retraction of the telescope fixtures 94 that hold the gliders.

Number 18 identifies a distributor which is here designed as a spray gun 60 which is continuously turned on the shaft 61 via a pivotal drive 62. The pivotal drive 62 is equipped with an air compressor 19 which is supplied with the necessary energy via the compressed air line which will be explained in greater detail at a later point. The compressed air line is identified with 20 whereas the product lines that carry the components are identified with 21 and 22. The mixer which here features a special shape, is identified with 23' whereas it is located in the head piece of the spray gun 60. The outlet opening is identified with 29 where the coating jet 30 exits and is guided evenly onto the inner wall of the pipe.

The entire vehicle 3 is moved on the gliders 11, 93 via a drive usually in the shape of the appropriate spool which is not depicted. During the procedure both components and the compressed air are guided into the vehicle 3 via the section of piping 4 where they will be inserted into the pivotal part via the media through put as shown in FIG. 1 and in FIG. 4. For this, the media through put 64 features a lengthwise extended cylinder casing 65 with the component connectors 66 and 67 as well as the compressed air connector 68. The compressed air connector 68 is connected with the compressed air powered pivotal drive whereas it is here indicated in the form of the air compressor 19. At any rate, this air powered pivotal drive ensures that the shaft 61 turns evenly and that it moves the spray gun 60 so that the coating jet 30 gradually covers the wall of the pipe. At the same time, the compressed air flows via the outer ring channel 70 and the axial drilling 71 all the way to the air gun 60 but also to other parts that are regulated or controlled-by compressed air. The two component connectors 66, 67 are connected with the outer ring channels 72 and 74 and guide the individual component via the axial drill hole 73 or 75 to the spray gun 60 where the mixing of the two components takes place in the mixer 23'.

The individual outer ring channels 70, 72, 74 are sealed against each other via the sealing rings 7 which are tightly positioned on the inner wall 78 of the cylinder casing 65 in the individual ring groove 76. The inner wall of the pipe 89 meaning the inner wall of the inner cylinder casing part 65 is made smooth enough so that an effective seal via the sealing rings 77 is ensured.

In the area of the final radial wall 79, buffer chambers 80, 81 are design on both sides. Those buffer in chambers can be intended to reduce the weight of the entire device, but they can also be connected with the air compressor meaning the compressed air connector 68 in such a way that this area is continuously pressurized so that at the same time it is ensured that the components or other parts cannot get into the way of the turning shaft 61. 63 indicates by the way the ball bearing which is to ensure an even turning of the shaft 61 in the cylinder casing 65.

The cylinder casing 65 consists of two flange pipes 82, 82' whose flanges 83, 83' are used to effectively link both parts. An appropriate screw fixing is indicated whereas the outer flange pipe 82' features a flange 82' on both sides whereas the inner flange pipe 82 features a flange 82 on only one side. On the opposite side a special flange 83" is utilized to connect both parts with each other. Appropriate details are shown on FIG. 10. Here, it is also visible that the outsides 84 of the sealing rings 77 close off a chamber 85 or 86 which are connected with the outer atmosphere via exchange drillings 87, 88. Should component material get into those chambers 85 or 86 due to sealing rings 77 that are no longer tight, it can be released through the exchange drilling 87, 88.

The shaft is turned by the pivotal drive 62 or the air powered pivotal drive 69 whereas a rope connector 93 for the rope pulling into the opposite direction 92 is attached to the free end 90 of the spray gun 60. This rope connector 91 is shaped as a pivotal head which prevents the rope that is pulling into the opposite direction 92 from twisting. Through this rope that is pulling into the opposite direction 92 first of all an even movement of the vehicle 3 is possible as well a correction if the spray gun 60 does not sit in the exact correct spray position. Due to the rope pulling into the opposite direction 92 the entire vehicle 3 can be moved backwards into the appropriate, correct position.

The telescope fixtures 94 that hold the gliders are designed to extend and retract. The pressure rollers 95 are put into either a horizontal brace position or in a release position via the pneumatic cylinders 96 so that a fixation of the vehicle 3 at the inner wall 58 of the pipe 1 is possible as well as a correction if the shaft 61 or the spray gun 60 is not exactly in the predetermined position which is necessary to ensure an even spraying of the two components onto the inner wall 58.

Figure 11:
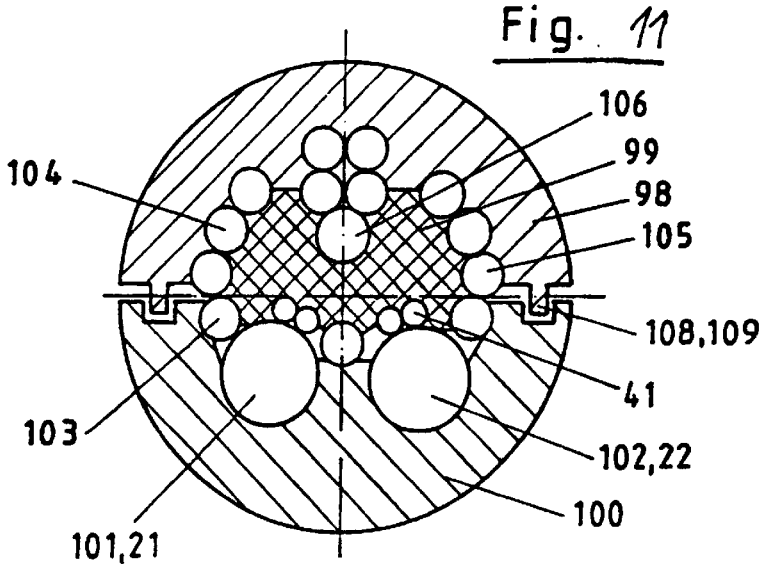
Figure 13:
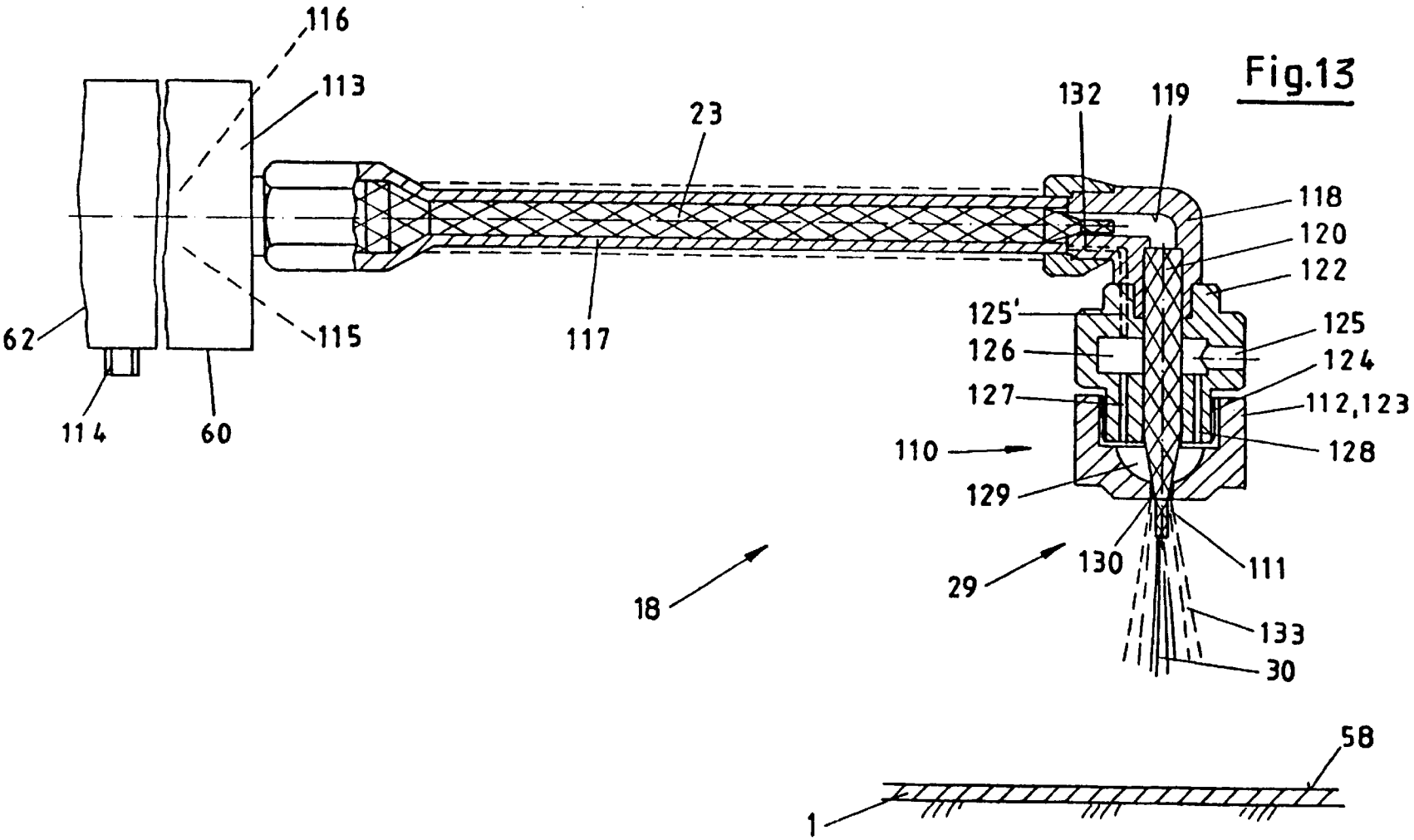
FIG. 13 a distributor with air jet

The FIGS. 11 and 13 show a section of piping 4 in a sectional drawing. The section of piping 4 consists of the two partial shells 98 and 100 which are connected with each other via a groove-spring-connection 108, 109 enclosing a middle piece 99. In the partial shells 98 and 100 as well as in the middle piece 99 there are channels 101, 102 or partial channels 103, 104, 105 where the product line 21, 22 as well as the compressed air line 20 can be placed as well as additional supply lines 106. By choosing an appropriate material it is thus possible to apply the necessary tensile forces via the section of piping 4 as well as proved the appropriate isolation that is necessary to create the product lines 21, 22 in such a way that he two components can be carried all the way to the spray gun 60 keeping the appropriate temperature.

Figure 12:
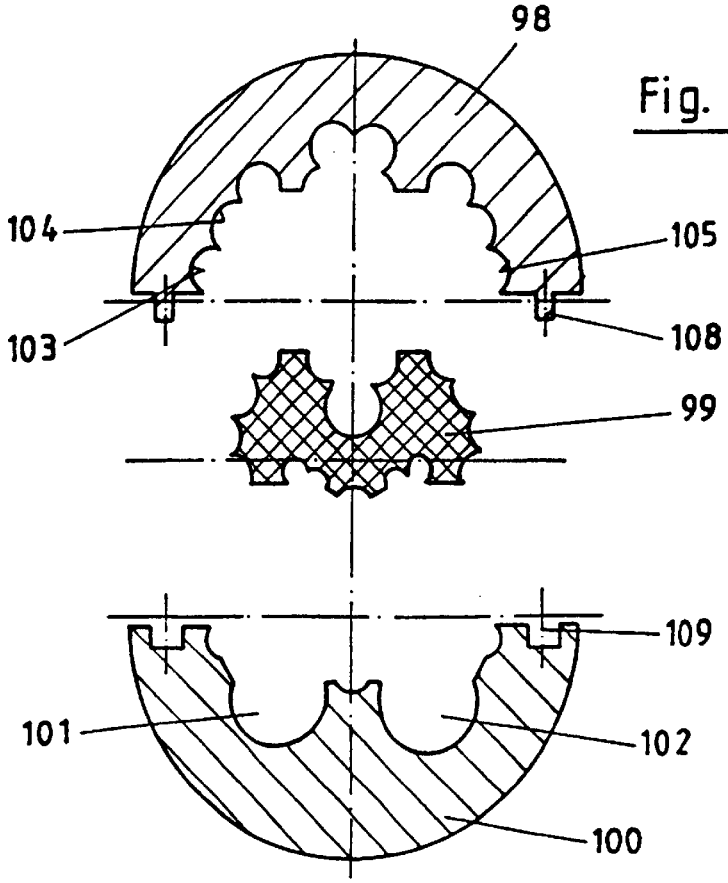

The set up is facilitated by the special design according to FIG. 11 and FIG. 12 whereas the two partial shells 98, 100 can be pushed into each other after the insertion of the product line 21, 22 together with the compressed air line 20 as well as additional supply lines 106 for which they feature the groove-spring-connection 108, 109. This groove-spring-connection can be designed so that based on its shape a first connection of joints takes place which for example can be permanently connected by inserting a glue or a plastic compound material.

In FIG. 13 a coating system is depicted which is intended for the restoration of a pipe 1 here in the shape of a duct. To coat the inner wall 58 of the pipe 1, a distributor 18 is intended which forms the end piece of the spray gun 60. This spray gun 60 or the distributor 18 is rotated via a rotary drive 62 so that the coating jet 30 which exits the outlet opening 29 always can be applied to the inner wall 58 in an axial direction. A mixer 23 is located inside the distributor 18 to mix the two components of the two component mixture sufficiently enough that they can be applied onto the inner wall in form of a quick hardening resin or Polyurethane. The supply is controlled by the media valves 115, 116, 113 indicates the spray head of the spray gun 60.

The distributor 18 first of all features a support pipe 17 which contains the mixer 23 and which corresponds with the spray head. When leaving the mixer 23, the two component mixture is guided through the angled pipe 118 with its specially stream supporting inner walls 119 into the area of the second mixer 120. The second mixer 120 ensures that the two component mixture exits from the outlet opening 29 in the area of the atomizer air jet 110 in a optimal composition or better in the optimal mixture due to the second mixing process.

The atomizer air jet 110 is equipped with an air adjustment nut 112 with a correspondingly adjusting media exit 111.

In the event of disturbances or shortly prior to turning off the distributor 18 compressed air can be lead into the distributor 18 via the connector 114 and thus into the supporting pipe 117 and the angled pipe 118 so that the remains of the two component mixture are pushed out and to thus prepare the distributor 18 for the next job.

The atomizer air jet 110 consists of a jet part 122 which is fixated with the angled pipe 118 and the moveable or pivotal jet part 123. For this, both jet parts 122, 123 feature a thread 124.

The required compressed air is added through the air connector 125 and first reaches the air distribution chamber 126 in the jet part 122 and then gets to the air distribution chamber 129 via the air channels 127, 128. This air distribution chamber 129 itself is shaped like a half dome so that the compressed air can exactly hit the area of the exit ring channel 130. The exit ring channel 130 ensures that the compressed air wraps around the coating jet 3 in form of an air layer and ensures that it forms an exit angle that is best suited for the inner wall 58. A useful positioning of the air connector 125 is the air connector 125' which is linked with the connector 114 by the connecting line 132. The connecting line 132 is accordingly integrated in the supporting pipe 117 and the angled pipe 118.

The exiting air supply stream 133 forms as indicated a type of protecting and guiding layer around the coating jet stream 30.

Figure 14:
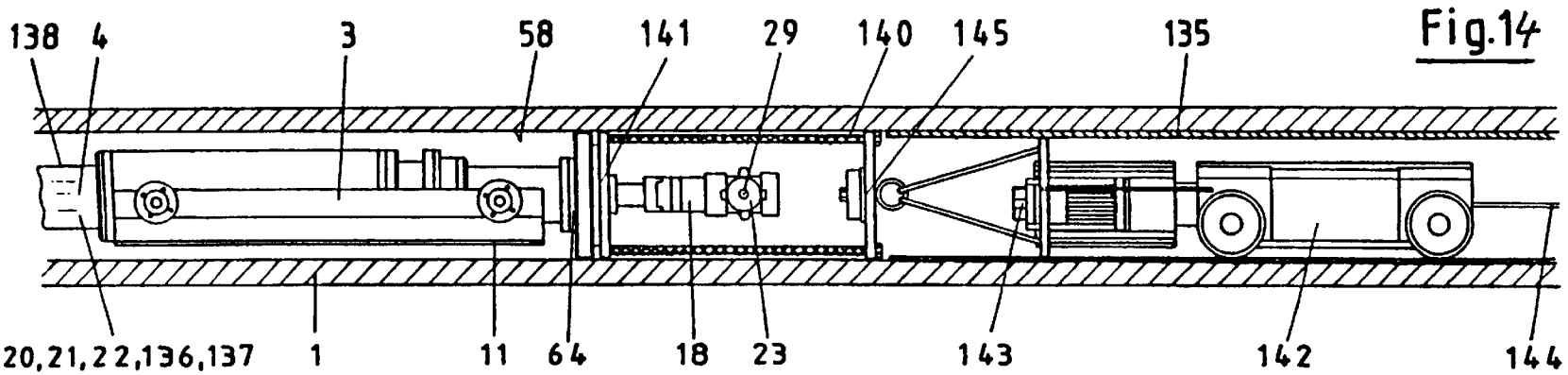
FIG. 14 a coating system with camera car in side view
Figure 15:
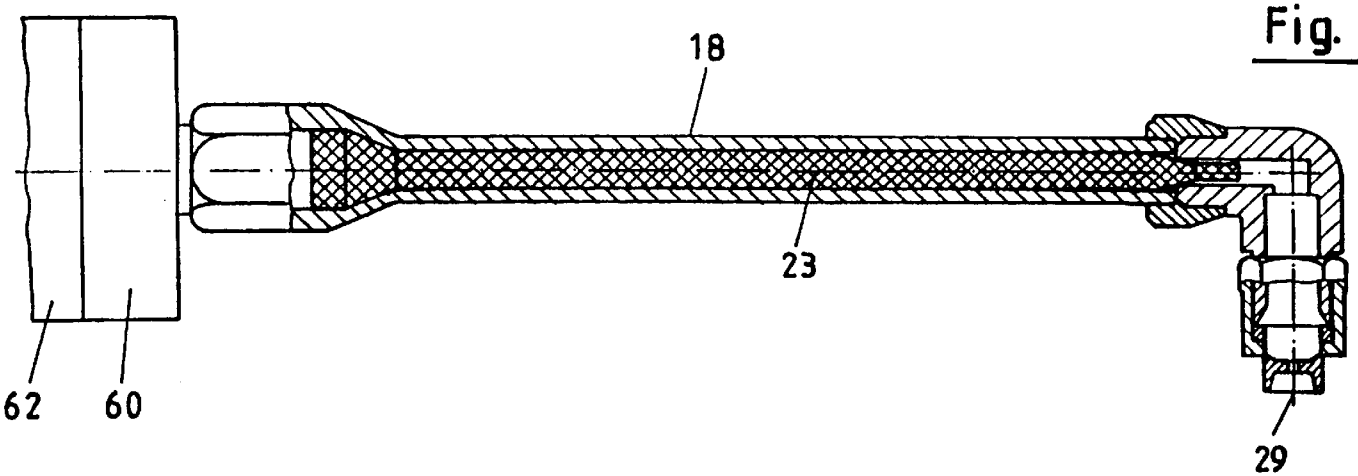
FIG. 15 a section of a rotating distributor.

FIG. 14 shows a pipe 1 in a longitudinal section that is to be restored whereas a vehicle 3 can be seen that can move into the longitudinal direction of the pile 1. This vehicle 3 is pulled via the section of piping 4 in longitudinal direction whereas the only indicated guiding gliders 11 ensure that it also is kept in the same central position. A rotating distributor 18 with a preceding mixer 23 is located in the front of the vehicle 3. It (the mixer) features an outlet opening 29 pointing towards the inner wall 58 of the pipe 1. The rotating distributor 18 is depicted in enlarged format in FIG. 15 where it is powered by a pivotal drive 62 and in the shape of a spray gun 60 is equipped with a mixer 23. Depicted is a so called Kennex mixer, whereas other kinds of rotating distributors 18 can also be used. On the end, an outlet opening 29 can be seen with an appropriate jet.

Not shown in detail is the fact that the section of piping 4 holds a compressed air line 20 as well product lines 21, 22 and in addition also electrical supply lines 136 as well as a low pressure line 137 if necessary whereas the latter will be further discussed at a later point.

The different media which are carried by the section of piping 4 are guided through a media through put 64 of a special design into the area of the spray gun 60.

With the rotating distributor 18 and the outlet opening 29, the coating material 135 is evenly applied onto the inner wall 58 of the pipe 1. Corresponding facts can be gathered from FIG. 14. Outside of the rotating distributor 135 there is the 'new' wall which is identified with 135. It ensures that the pipe 1 or the corresponding duct can fulfill its full function for a long time to come after the completion of the restoration process.

In the design according to FIG. 14, a camera car can be seen with a lens 143 that extends towards the rotating distributor 18. This camera car 142 is connected with the rotating distributor 18 via a pivotal frame 140 so that it can turn together with the distributor 18. The outlet opening 29 can therefore apply coating material 135 onto the inner wall 58 without being hindered by the pivotal frame 140. A corresponding connector 141 which ensures the turning motion features a quasi connection with the pivotal drive 62. The camera car 142 itself is attached onto the pivotal frame 140 by a pivotal eyelet 145 so that the pivotal frame 140 can turn without influencing the position of the camera car 142. A rope 144 is attached at the opposite end of the camera car 142 so that the camera car 142 and therefore the entire coating system also can be pulled back into the restored area of the pipe 1. Thus, a reworking of the wall is indeed possible if this is deemed necessary for whatever reason.

Figure 16:
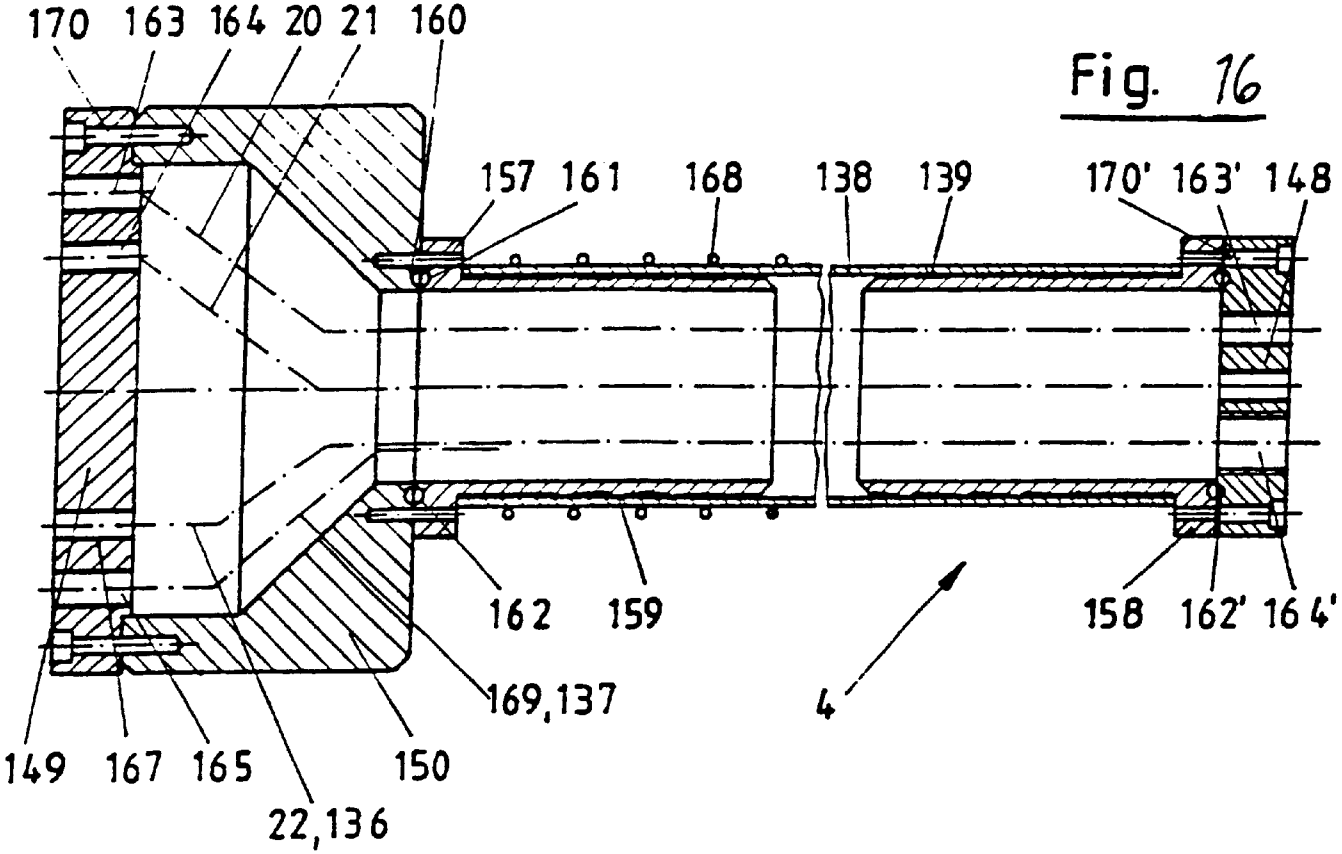
FIG. 16 a section of piping with inflatable tube.

The section of piping 4 features a tube 138 which makes up the outer wall, whereas appropriate details can be seen on FIG. 16. Here, the entire section of piping 4 is depicted which can reach a length of 150 meters and more. The wall 139 of the tube 138 is designed so that it can absorb the necessary tensile forces but also that on the other hand an inflation between the cover 148 on the side of the vehicle and the cover 149 on the side of the tube spool is possible. The cover 149 on the side of the tube spool is supported by the terminal block 150 so that an effective fixation with the tube spool, which is not depicted here, is possible.

FIG. 16 also shows the front part of the rotating distributor 18. The compressed air line 20 as well as the product lines 21, 22 lead into the front head, which means into the mixer 23, whereas the two product lines 21, 22 come in exactly opposite from each other. The mixer has a ball shaped mixing chamber 153 into which the individual connecting spouts 154, 155 or the compressed air line 20 lead into. Opposite of the compressed air line 20 a jet line 56 leads to the outlet opening 29 with an appropriate jet which is not further discussed here, so that the components which enter through the connecting spouts 154, 155 are mixed intensively in the ball shaped mixing chamber 153 and then are whisked away by the air stream that exits from the air jet 152 and are applied through the outlet opening 29. The materials that have been extensively mixed with each other are then applied onto the inner wall 58 by an appropriate beam depending on the jet.

The tube that is identified by 138 is connected with the cover 148 on the side of the vehicle and the cover 149 on the side of the tube spool featuring a terminal block 150 via tube spouts 157, 158 whereas these tube spouts 157, 158 with their outer teeth are pushed appropriately far into the tube 138. The shape of the outer teeth 159 is especially shown on FIG. 8 where it is visible that after the insertion of the appropriate tube spout 157, 158 into the tube 138 it is practically impossible to pull it back out especially when the tube 138 is inflated. Not depicted are tube clamps which also prevent the involuntary back or outwards movement of the tube 138.

The tube spouts 157, 158 feature connecting screws 170 with which they can be connected on the one hand with the terminal block or with the appropriate covers 148, 149. An O-ring 162 is positioned between the terminal block 150 and the cover 148 on the side of the vehicle whereas both parts feature a ring groove 160, 161. In its mounted position, the O-ring 162 is set tightly so that compressed air cannot exit at this point.

The individual covers 148, 149 feature drillings 163, 164 to take in product lines 21, 22 or the compressed air line 20 or other lines 136, 137. Thus, the appropriate lines are bundled or inserted into the tube 138 in an orderly fashion so that it cannot lead to overlapping or twisting when the tube 138 is inflated and filled with compressed air. For this, a low pressure line 137 is intended which as can be seen reaches into the area of the tube 138. Compressed air is inserted via the low pressure line 137 so that the tube 138 inflates and so that an appropriate security and insulation of the lines 20, 21, 22, 136, 137 is ensured. The fact that the corresponding lines are equally positioned in both covers 148, 149 a clear positioning of the lines inside the tube 138 even with lengths of 150 meters and more is given.

The low pressure line 137 leads through the connecting drill hole 165 whereas the connecting drill how 165 as well as the drill holes 163, 164 feature a coating material which corresponds with the outer wall 166 of the lines 21, 22, 20, 136. Thus an effective seal is ensured also in this area and an advantageous predetermination of the individual lines is ensured.

The tube 138 can feature a reinforcement 168 in order to establish an additional strengthening of the tube 138. The reinforcement 168 does not hinder the tube 138 to be rolled up. The reinforcement 168 can be positioned on the outer coat, on the inner wall or inside the wall 139 of the tube 138. It can have a ring shape or spiral shape.

The low pressure line is identified with 137 but also with 169 in order to show that pressure of 2 to 4 bar can be applied but it can also operate with higher pressures if this is deemed necessary.

All listed characteristics which are also depicted on the drawings, individually or in combination with each other are being considered essential for the invention.

What is claimed is:

1. A coating system to coat the inside of pipes (1) and similar longitudinally stretched hollow objects in the form of a vehicle with a distributor which can travel lengthwise through a pipe whereas the components of the coating agent are separated up to the distributor in a common section of piping, are then intensively mixed and as a mixture applied onto the inner walls of the pipe in travel direction behind the vehicle, the vehicle is designed with space holders that compensate irregularities of the inner wall of the pipe and that can be adjusted to fit the individual diameter of the inner wall of the pipe and that it can be moved forwards and backwards inside the pipe to correct mistakes whereas the pulling section of piping is always kept tight and at the points where it changes the direction it is guided by rollers that secure the predetermined angle of redirection and it is also guided during the rolling on and off process of the spool and thus always remains connected with the coating agent storage container, which is equipped with a vehicle (3) that is guided along the inner wall (26) of the pipe (1) by a drive and which features a distributor (19) for the coating agent, the vehicle (3) is connected with at least one coating agent storage container (8) via a flexible section of piping (4) whereas the section of piping (4) is connected with a spool (7) positioned outside the pipe (1)

characterized by the fact that the spool (7) features a drive (47) and a central, pipe-shaped spool axis (49) whose at least one free end is equipped with a sealed pivotal connector (52, 53) at whose solid part at least one feed line (54) from a coating agent supply container (8) comes it and whose part that is connected with the pivotal part of the spool (7) is connected to one of the product lines (21, 22) in the section of piping (4) which in turn forms the tensile section of piping (4) together with if necessary additional for the operation of the vehicle required supply lines, the section of piping (4) can be rolled onto the spool (7), the vehicle (3) then also features a camera car (142) and a rope (9, 144) on the side where the rotating distributor (19) is located, wherein the section of piping (4) consists of the two separate product lines (21, 22) which can be heated and two partial shells (98, 100) and a middle piece (99) which features channels (101, 102) or partial channels (103, 104, 105) for the product lines (21, 22) and additional support lines (106).

2. A coating system according to claim 1, characterized by the fact that the drive (47) of the spool (7) and the drive (46) of a pair of preceding pressure rollers (42) feature an electronic control which match the even pulling force one the one hand and the speed to roll up the section of piping on the other hand.

3. A coating system according to claim 1, characterized by the fact that two pairs of pressure rollers (42, 42') are intended which are positioned one after the other towards the pulling motion of which each features one pressure roller (44) that is powered whereas the other pressure roller (45) follows due the frictional pressure of the coating surface of the section of piping (4) while the drive (47) of the spool (7) is built so that is follows the drive (46) of the pairs of pressure rollers and at least one pair of pressure rollers (42, 42') can be extended parallel to the spool axis (49) preferably on a carriage (50).

4. A coating system according to claim 1, characterized by the fact that the vehicle (3) features a casing with six or more in radial direction extended gliding skids (11) whose contact surface (13) can be set towards the longitudinal middle axis (14) of the vehicle (3).

5. A coating system according to claim 1, characterized by the fact that the rotating distributor (18) is designed as a rotation symmetrical pot with outlet openings and that it features a pipe (24) which leads into the inside of the pot and is fixated opposite to the casing of the vehicle (3) and features a beveled open end piece whereas as the slanted opening (25) points outwards to the closest area of the inside wall (26) of the pot.

6. A coating system according to claim 1, characterized by the fact that the rotating distributor (18) is designed to function as a spray-gun (60) with a radial positioned outlet opening (29) and integrated mixer (23') and that the shaft (61) of the pivotal drive (62) which turns the spray gun (60) features a media through put (64) or is a media through put.

7. A coating system according to claim 1, characterized by the fact that a media through put (64) is designed as a cylinder casing (65) with a component connectors ((66, 67) for the two components and a compressed air connector (68) and that the cylinder casing (65) houses a shaft (61) which is connected with the compressed air powered pivotal drive (69) and that the shaft (61) features outer ring channels (70, 72, 74) and axial sack drillings (71, 73, 75) that correspond with the connectors (66, 67, 68).

8. A coating system according to claim 1, characterized by the fact that the rotating distributor (18) features a radial positioned and executing outlet opening (29) which corresponds with an atomizer air spray jet (110) which is fitted with an airflow change nut (112) that influences the spray angle of the media output (111).

9. A coating system to coat inside of pipes (1) and similar longitudinally stretched hollow objects in the form of a vehicle with a distributor which can travel lengthwise through a pipe whereas the components of the coating agent are separated up to the distributor in a common section of piping, are then intensively mixed and as a mixture applied onto the inner walls of the pipe in travel direction behind the vehicle, the vehicle is designed with space holders that compensate irregularities of the inner wall of the pipe and that can be adjusted to fit the individual diameter of the inner wall of the pipe and that it can be moved forwards and backwards inside the pipe to correct mistakes whereas the pulling section of piping is always kept tight and at the points where it changes the direction it is guided by rollers that secure the predetermined angle of redirection and it is also guided during the rolling on and off process of the spool and thus always remains connected with the coating agent storage container, characterized by the fact that the rotating distributor (18) consists of a supporting pipe (117) with interior mixer (23) which is connected with the spray head (113) of the spray gun (60), an angled pipe (118) with the outlet opening (29) and an air pressure regulating nut (112) whereas in the end piece of the angled pipe (118) which points towards the inner wall (58) there is an additional mixer (12) reaching all the way into the outlet opening (29) and whereas them atomizer air jet (110) is detachably connected with the angled pipe (118) and consists of two jet parts (122, 123) which are connected via a thread (124) and of which the jet part (123) that is positioned at the free end is designed as the air regulating nut (112).

10. A coating system according to claim 9, characterized by the fact that the jet part (122) that is connected with the angled pipe (118) features an air connector (125) and an air distribution chamber (126) which is connected via axial air channels (127, 128) with a second air distribution chamber (129) in the air pressure regulating nut (112), whereas a connector (114) for compressed air is intended in the area of the spray head (113) which via a pivotal connector ensures a continuous supply of air and which can be connected between the supporting pipe (117) or the mixer (123) and the medium valves (115, 116).

11. A coating system according to claim 10, characterized by the fact that the integrating product lines (21, 22) and electrical supply lines (136) are integrated in a highly resistant flexible tube (138) building the section of piping (4), at the end facing the vehicle the section of piping is air tightly sealed by a cover (148) or facing the tube spool side it is air-tightly sealed by a cover (149) featuring a terminal block (150) and at the same time it is configured to absorb tensile forces, the product lines (21, 22) which transport the two components of the coating material (135) point towards each other in the mixer (23) preceding the outlet opening (29) which also features a compressed air supply line (20) with air jet (152) that connects in a right angle to it.

12. A coating system according to claim 11, characterized by the fact that the cover (148, 149) or the terminal block (15) is connected with a tube spout (157, 158) which holding the highly resistant tube by an outer teethed is positioned far into the tube and held by an outer teethed link and which is equipped with corresponding ring grooves to hold an O-ring.

13. A coating system according to claim 11, characterized by the fact that the wall (139) or the highly resistant tube (138) features a reinforcement (168).

14. A coating system according to claim 12, characterized by the fact that the cover (149) on the side of the tube spool features a connector drilling (165) for a low pressure line (137) to add compressed air, preferably ranging from 2 to 4 bar and that the drilling (163, 164, 165) features a sealing coating (167) that works together with the outer wall (166) of the product lines (21, 22), compressed air line (20) and supply line (136).

* * * * *